US005502856A

United States Patent [19]

Smith

[11] Patent Number: 5,502,856

[45] Date of Patent: Apr. 2, 1996

[54] DYEING TEXTILE ARTICLES

[75] Inventor: George F. Smith, Ambergate, England

[73] Assignee: CV Apparel Limited, Nottinghamshire, England

[21] Appl. No.: 256,488

[22] PCT Filed: Jan. 8, 1993

[86] PCT No.: PCT/GB93/00031

§ 371 Date: Sep. 7, 1994

§ 102(e) Date: Sep. 7, 1994

[87] PCT Pub. No.: WO93/14256

PCT Pub. Date: Jul. 22, 1993

[30] Foreign Application Priority Data

Jan. 15, 1992 [GB] United Kingdom ..... 9200810

[51] Int. Cl.[6] ..... D06B 5/24

[52] U.S. Cl. ..... 8/150; 8/158; 68/184; 68/199; 68/205 R

[58] Field of Search ..... 8/150, 154, 155.2, 8/158; 68/181 R, 184, 187, 188, 189, 194, 199, 205 R, 207

[56] References Cited

U.S. PATENT DOCUMENTS

| | | | |
|---|---|---|---|
| 1,567,568 | 12/1925 | Brandwood et al. | 68/189 |
| 2,207,682 | 7/1940 | Higginson | 68/199 |
| 2,522,806 | 9/1950 | Stageberg | 68/207 X |
| 2,985,502 | 5/1961 | Kronsbein et al. | 8/150 |
| 4,231,236 | 11/1980 | Tratta et al. | 68/187 X |

FOREIGN PATENT DOCUMENTS

| | | | |
|---|---|---|---|
| 20146 | 11/1929 | Australia | 68/187 |
| 0345617 | 12/1989 | European Pat. Off. . | |
| 820175 | 7/1937 | France | 68/184 |
| 2290520 | 6/1976 | France . | |
| 2388071 | 11/1978 | France . | |
| 1635086 | 3/1971 | Germany . | |
| 579059 | 7/1958 | Italy | 68/189 |
| 2310 | of 1881 | United Kingdom | 68/189 |
| 10423 | of 1909 | United Kingdom | 68/184 |
| 404370 | 1/1934 | United Kingdom | 68/184 |

*Primary Examiner*—Philip R. Coe
*Attorney, Agent, or Firm*—John R. Ley; John B. Phillips

[57] ABSTRACT

Method and apparatus for dyeing textile articles in which the articles are confined in bulk but in orderly fashion in a dyebath up to a level therein, the dyebath is loaded with dye liquor to cover the articles and the liquor is circulated through forceful sprays directed towards the articles from above said level.

25 Claims, 1 Drawing Sheet

DYEING TEXTILE ARTICLES

Figure 1:
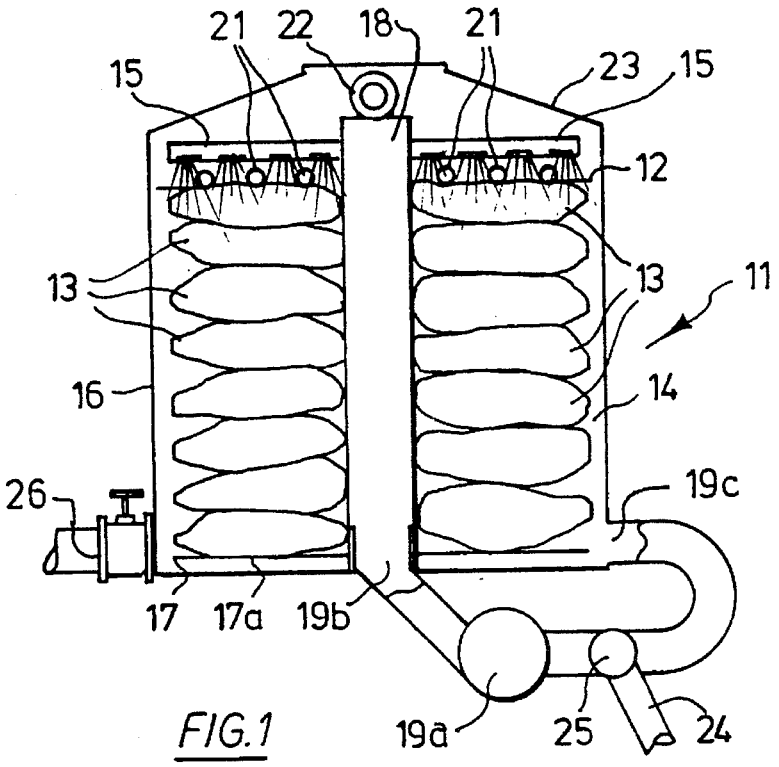

This invention relates to dyeing textile articles and in particular, though not necessarily exclusively, to the dyeing of hosiery such as ladies' stockings and tights.

There are many ways of dyeing textile articles and many different types of dyeing machinery. The problem is always to find an economical method which can be carried out on machinery of low capital cost and maintenance requirements which is, however, effective to produce uniform dyeing both from article to article and as between different parts of the same article.

The invention provides a method which is particularly satisfactory, at least for the dyeing of ladies hosiery, in all of these regards and machinery for carrying out the method.

The invention comprises a method for dyeing textile articles comprising confining said articles in bulk but in orderly fashion in a dyebath up to a level therein, loading the dyebath with dye liquor to cover the articles and circulating said liquor through forceful sprays directed towards the articles from above said level.

Pretreatment of the articles, including scouring and the application of dyeing assistants such as levellers and retarders, may be carried out in the dyebath with liquid circulated through said sprays.

The articles may be packed in readily penetrable bags and a plurality of such bags packed in the dye bath. Hosiery articles such as stockings and tights may advantageously be packed flat in the bags rather than just being bundled in; the orderly packing avoids tight tangles resistive to dye liquor penetration, and facilitates unpacking.

The invention also comprises apparatus for dyeing textile articles comprising a dyebath loadable up to a level with articles to be dyed and circulating means for circulating dye liquor through the dyebath including forceful sprays located above said level and directed downwardly at articles confined in the dyebath.

The dyebath may comprise an open topped container and a removable insert, the insert comprising a carrier for carrying the articles to be dyed in bulk but in orderly fashion and having a column from which extends, above said level, an array of perforated tubes constituting said sprays and connected via said column to forced circulation means for the container.

The container may have a removable lid to prevent spashing out of liquor during the dyeing process, and the lid may be carried on the removable carrier.

The container may be rectangular in plan, the column extending along the container, desirably in a central position so that the array of sprays extends either side of the column.

The carrier may comprise a framework adapted to confine a charge of articles to be dyed so that the articles can be loaded into the framework with the carrier removed from the container and the loaded carrier then lowered into the open topped container. The provision of a second carrier allows one to be in use for dyeing while the second is being charged for instant loading into the container as soon as the dyeing operation on the first is completed.

Figure 2:
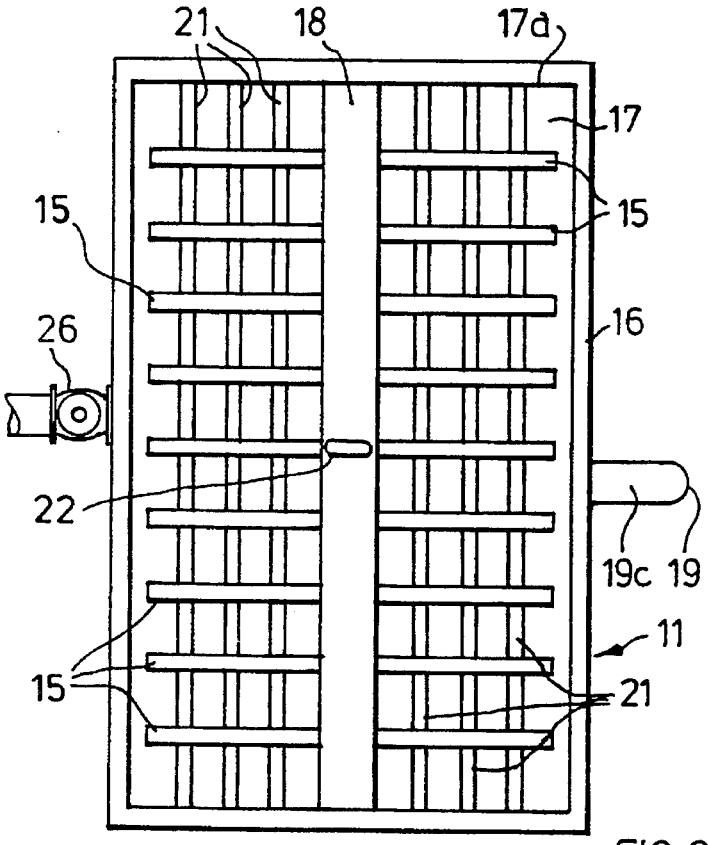

Embodiments of apparatus and methods for dyeing textile articles will now be described with reference to the accompanying drawings, in which:

FIG. 1 is a cross-section of one embodiment of apparatus; and FIG. 2 is a plan view of the apparatus of FIG. 1.

The apparatus illustrated in FIGS. 1 and 2 comprises a dyebath 11 loadable up to a level 12 with articles 13 to be dyed, and circulating means for circulating dye liquor 14 through the dyebath 11 including forceful sprays 15 located above said level 12 and directed downwardly at articles 13 confined in the dyebath 11.

The dyebath 11 comprises an open topped container 16 and a removable insert 17, the insert comprising a carrier for carrying the articles 13 in bulk but in orderly fashion, and having a column 18 from which extends, above said level 12, an array of perforated tubes constituting said sprays 15 and connected via said column 18 to forced circulation means 19 for the container. The circulation means 19 comprise a powerful pump **19*a* delivering to an inlet 19*b* to the container 16 beneath the column 18 and receiving liquor 14 from the container 16 from a bottom outlet 19*c* thereof. There may be several inlets 19*b* and outlets 19*c* spaced apart in the container 16 to ensure even circulation throughout the dyebath 11**.

The container 16 is rectangular in plan and the column 18 extends midway thereof from end to end.

The carrier 17 is adapted to confine a charge of articles 13 to be dyed so that the articles can be loaded into the framework on the base **17*a* thereof with the carrier 17 removed from the container 16. The articles are constrained in the carrier by a framework of rods 21 stretching along the length of the carrier, parallel to the column 18. The carrier 17 has a hoisting ring 22 the hoist attachment also carrying a lid 23** to cover the arrangement and prevent splashing out during operation.

In use, a second carrier 17 can be loaded with the next charge of articles 13 to be dyed while a first carrier is in the dyebath.

The loaded carrier 17 may be put into the empty container 16 at the start of the dyeing process and a scouring operation performed by introducing a scouring liquid into the dyebath 11 and circulating the liquid so that it is sprayed on to the articles 13. The scouring liquid is allowed to build up until the articles are covered and scouring continued for as long as deemed necessary. The scouring liquid can then be drained off through a valved drain 24 and any other desired pretreatment applied to the articles 13 by introducing liquid containing chemicals as may be desired as for the scouring liquid. This liquid is then drained off when appropriate and the dye liquor admitted in the same say.

The pump power and the spray arrangement are such as will effect rapid penetration of dye liquor as a result of the kinetic energy of the dye liquor emerging from the sprays 15 right down to the lowermost articles in the charge, and so that liquor will still circulate through these lowermost articles at least partly as a result of its initial kinetic energy from the spray.

The articles 13 are packed in batches in loosely knitted bags. If the articles are ladies' hosiery, they can be arranged flat and generally aligned in the bags which are tied so as to hold their contents firmly but not tightly, so that liquor can readily penetrate but that even under the force of the jets, the contents are held against substantial movements, so that when the process is over they can be readily unpacked without the need for unravelling.

A dyebath as illustrated may have a volume of several cubic meters and hold a charge of many thousand hosiery articles. It is found that using the forced spray circulation all the articles in a charge are dyed uniformly and without tangling.

Other embodiments of apparatus may of course be contemplated—the apparatus may for example be circular in plan with an axial column and jets and framework members radiating therefrom.

It may be the case that the effectiveness of the method and the apparatus as described is due at least in part to the turbulence created at all levels by the effect of the jets. It is not necessary to have the jets above the level of liquid in the dyebath, but this does permit of visual inspection to check that the jets are all functioning properly.

I claim:

1. A method for dyeing textile articles comprising the steps of confining said articles in bulk but in orderly fashion from a bottom level to an upper level in a dyebath; loading the dyebath with dye liquor to cover the articles; and circulating said liquor through the dyebath by steps including directing forceful sprays of liquor towards the articles to energize the liquor with sufficient kinetic energy to penetrate articles at the bottom level of the dyebath with the energized liquor.

2. A method according to claim 1, further comprising the step of pre-treating the articles in the dyebath by steps including circulating treatment liquid through said sprays prior to loading the dyebath with dye liquor.

3. A method according to claim 2, wherein the step of pre-treating the articles includes scouring the articles with the treatment liquid.

4. A method according to claim 2, wherein the step of pre-treating the articles includes applying a dyeing assistant to the articles with the treatment liquid.

5. A method according to claim 4, wherein the dyeing assistant is a leveller.

6. A method according to claim 4, wherein the dyeing assistant is a retarder.

7. A method according to claim 1 or claim 2, further comprising the steps of packing articles in a plurality of bags which are readily penetrable by said liquor, and packing a plurality of the bags in the dyebath.

8. A method according to claim 7, in which the articles are hosiery articles and further comprising the step of packing the hosiery articles flat in the bags.

9. A method according to claim 8, wherein the hosiery articles are stockings.

10. A method according to claim 8, wherein the hosiery articles are tights.

11. A method according to claim 1, wherein the forceful sprays of liquor are directed towards the articles from above said upper level.

12. A method according to claim 1, wherein the step of confining the articles in the dyebath further comprises:

loading the articles on a framework of a carrier when the carrier is removed from the dyebath; and lowering the carrier into the dyebath after the framework is loaded with articles.

13. A method according to claim 12, further comprising the steps of providing a second carrier in addition to the carrier first aforesaid, loading additional articles on a framework of the second carrier when the second carrier is removed from the dyebath and the first carrier is in the dyebath, removing the first carrier from the dyebath at the conclusion of dyeing the articles on the first carrier, and immediately after removing the first carrier lowering the second carrier into the dyebath after its framework has been loaded with articles.

14. Apparatus for dyeing textile articles comprising a dyebath loadable between a bottom level and an upper level with articles to be dyed; and circulating means for circulating dye liquor through the dyebath, said circulating means including:

a pump; and sprays located in the dyebath and connected to the pump to forcefully direct dye liquor at articles confined in the dyebath, said sprays energizing the dye liquor with sufficient kinetic energy to penetrate articles at the bottom level of the dyebath.

15. Apparatus according to claim 14, wherein the dyebath includes an open topped container to hold the dye liquor, and further comprising:

an insert adapted to be removed from the open topped container, the insert comprising a carrier for carrying the articles to be dyed in bulk but orderly fashion, said carrier having a column from which there extends an array of said sprays, said column connected in fluid communication to the pump to supply dye liquor to said array of sprays.

16. Apparatus according to claim 15, comprising a removable lid for the container.

17. Apparatus according to claim 16, in which the lid is carried on the removable insert.

18. Apparatus according to any one of claims 16 or 17 in which the container is rectangular in plan.

19. Apparatus according to claim 15, in which the column extends along the container.

20. Apparatus according to claim 19, in which the column extends along the container in a central position so that the array of sprays extends either side of the column.

21. Apparatus according to claim 15, wherein said array of sprays comprise an array of perforated tubes extending from said column.

22. Apparatus according to claim 15, wherein the container is rectangular in plan.

23. Apparatus according to any one of claims 15, 16, 17, 19, 20 or 22, in which the carrier comprises a framework adapted to confine a charge of articles to be dyed and to allow the articles to be loaded into the framework with the carrier removed from the container and to allow the loaded carrier to be lowered into the opened topped container.

24. Apparatus according to claim 23, comprising a second carrier which can be charged whilst the first is in use for dyeing.

25. Apparatus according to claim 14, wherein the sprays in the dyebath are positioned above said upper level to forcefully direct the dye liquor downwardly at the articles confined in the dyebath.

* * * * *